US006702768B2

(12) United States Patent
Mano et al.

(10) Patent No.: US 6,702,768 B2
(45) Date of Patent: Mar. 9, 2004

(54) FOOT BENDING AND STRETCHING APPARATUS

(75) Inventors: Nobue Mano, Komaki (JP); Chikao Harada, Komaki (JP)

(73) Assignee: Colin Corporation

( * ) Notice: Subject to any disclaimer, the term of this patent is extended or adjusted under 35 U.S.C. 154(b) by 148 days.

(21) Appl. No.: 09/964,431

(22) Filed: Sep. 28, 2001

(65) Prior Publication Data

US 2002/0049397 A1 Apr. 25, 2002

(30) Foreign Application Priority Data

Oct. 19, 2000 (JP) ..... 2000-318712

(51) Int. Cl.[7] ..... A61H 1/02; A61H 23/02

(52) U.S. Cl. ..... 601/29; 601/31; 601/32; 601/149; 601/150

(58) Field of Search ..... 601/148–152, 601/27–32, 34, 35

(56) References Cited

U.S. PATENT DOCUMENTS

| | | | | | |
|---|---|---|---|---|---|
| 2,880,721 | A | * | 4/1959 | Corcoran | 601/151 |
| 4,003,374 | A | | 1/1977 | Mizrachy | |
| 4,614,179 | A | * | 9/1986 | Gardner et al. | 601/30 |
| 4,624,244 | A | * | 11/1986 | Taheri | 601/152 |
| 5,443,440 | A | * | 8/1995 | Tumey et al. | 601/152 |
| 5,453,082 | A | * | 9/1995 | Lamont | 601/148 |
| 6,010,468 | A | * | 1/2000 | Grove et al. | 601/23 |
| 2001/0018564 | A1 | * | 8/2001 | Manor et al. | 601/152 |

FOREIGN PATENT DOCUMENTS

| | | |
|---|---|---|
| DE | 2 261 989 | 6/1974 |
| DE | 36 05 621 A1 | 8/1987 |
| JP | 9-253144 | 9/1997 |
| WO | WO 00/06077 | 2/2000 |

* cited by examiner

*Primary Examiner*—Danton D. DeMille
(74) *Attorney, Agent, or Firm*—Oliff & Berridge, PLC

(57) ABSTRACT

An apparatus for bending and stretching a foot of a living person by pressing at least an arch of a sole of the foot and stopping the pressing of the arch.

11 Claims, 8 Drawing Sheets

FOOT BENDING AND STRETCHING APPARATUS

BACKGROUND OF THE INVENTION

1. Field of the Invention

The present invention relates to an apparatus for forcibly bending a foot about a foot joint of an inferior limb of a living person, while pressing a sole (planta pedis) of the foot, thereby preventing foot-drop (talipes equinus) and deep venous thrombosis.

2. Related Art Statement

A patient who has been ill in bed for a long time is likely to suffer foot-drop, i.e., the disease that foot joint cannot be bent from its stretched position. Some patients suffer this disease in two weeks only. A patient who suffers foot-drop cannot easily walk and needs a long time to achieve rehabilitation. Thus, it is strongly desirable to prevent foot-drop. Foot-drop can be prevented by sometimes bending the foot. However, many patients who suffer foot-drop cannot bend their feet without help, because of, e.g., paralysis of peroneal nerve.

There has been developed no apparatus for preventing foot-drop, and there has been proposed only a training apparatus for restoring the function of a foot suffering foot-drop. For example, Japanese Patent Document No. 9-253144 discloses a function-restoring training apparatus. This training apparatus includes an air bag which is provided in vicinity of an ankle on the side of an instep (dorsum pedis); a support band which has a shape of loop, is wound around a portion of a lower leg located between the ankle and the knee, is connected at one end thereof to the air bag, and fixes the air bag to the ankle; and a tension band which has a shape of loop, is wound around a portion of a sole located between toes and a heel, and is connected at one end thereof to an upper surface of the air bag. When the air bag is charged with air and the air is discharged from the air bag, the air bag pulls, and loosens, the tension band, thereby forcibly bending the foot about the foot joint.

It is speculated that if a patient uses the above-indicated function-restoring apparatus before he or she suffers foot-drop, he or she can prevent the disease. On the other hand, a patient who has been ill in bed for a long time is likely to suffer deep venous thrombosis (DVT), i.e., the disease that blood clots develop and float in veins of an inferior limb, and even clog the veins, because his or her blood is likely to stay in the veins. This disease is accelerated if the patient has the problem of abnormal coagulation or dehydration, and may develop in from several hours to one day.

There has been proposed an apparatus for preventing the above-indicated deep venous thrombosis. This apparatus includes a support belt which supports an air bag and is worn on a foot of a living person such that the air bag is positioned on the sole of the foot and so that the air bag is supplied with pressurized air and is inflated to press the sole. When a living person walks, venous blood is pumped up from the veins of the sole of foot by the pressure caused by load, and is conveyed from the inferior limb to the heart. However, a patient who has been ill in bed for a long time is short of the pressure applied to his or her sole and accordingly is likely to suffer venous thrombosis. Hence, if the above-indicated apparatus is used to press the sole, deep venous thrombosis can be prevented. However, the apparatus that can only press sole cannot prevent foot-drop.

Thus, according to the conventional art, both a foot-drop preventing apparatus and a deep-venous-thrombosis preventing apparatus must be used to prevent foot-drop and deep venous thrombosis. That is, first, a patient wears the foot-drop preventing apparatus on his or her foot, performs a prescribed operation to prevent foot-drop, then puts the apparatus off the foot, subsequently wears the deep-venous-thrombosis preventing apparatus on the foot, and then performs a prescribed operation to prevent deep venous thrombosis. These actions are very cumbersome and time-consuming.

SUMMARY OF THE INVENTION

It is therefore an object of the present invention to provide an apparatus for simultaneously preventing foot-drop and deep venous thrombosis.

The above object has been achieved by the present invention. According to a first feature of the present invention, there is provided an apparatus for bending and stretching a foot of a living person by pressing at least an arch of a sole of the foot and stopping the pressing of the arch.

According to this feature, while at least the arch of the foot is pressed, the foot is bent; and when the pressing of the arch is stopped, the foot is naturally returned to its stretched state. When these actions are repeated, the bending and stretching of the foot are repeated. Thus, the foot is prevented from foot-drop. In addition, since at least the arch of the foot is pressed while the foot is bent, the foot is prevented from deep venous thrombosis.

According to a second feature of the present invention, there is provided an apparatus for bending and stretching a foot of a living person, comprising a pressurized-gas supplying device which supplies a pressurized gas; and an inflatable bag which is provided in vicinity of an arch of a sole of the foot, and is inflated by the pressurized gas supplied by the pressurized-gas supplying device, so as to press at least the arch of the sole of the foot.

According to this feature, when the inflatable bag is inflated by the pressurized gas supplied by the pressurized-gas supplying device, the inflated bag presses at least the arch of the sole, thereby bending the foot. When the inflation of the bag is stopped, the pressing of the sole is also stopped, so that the foot is naturally returned to its stretched state. Since the foot can be iteratively bent and stretched by repeating these actions, the foot can be prevented from foot-drop. In addition, since at least the arch of the foot is pressed while the foot is bent, the foot is prevented from deep venous thrombosis.

According to a third feature of the present invention, there is provided an apparatus for bending and stretching a foot of a living person, comprising a support plate including a base portion which is adapted to be worn on a lower portion of an inferior limb of the person such that the base portion is not movable relative to the inferior limb, and an end portion which is inclined relative to the base portion in a direction away from the foot of the inferior limb and is opposed to an instep of the foot; an inflatable bag which is provided on one of opposite sides of the end portion of the support plate that is opposite to the instep; a pressurized-gas supplying device which supplies a pressurized gas to the inflatable bag; a pressing member which is provided in vicinity of an arch of a sole of the foot; and a binding member which binds the end portion of the support plate, the inflatable bag, and the pressing member, around the foot, such that the bag is inflatable by the pressurized gas supplied by the pressurized-gas supplying device.

According to this feature, the binding member binds the end portion of the support plate, the inflatable bag, and the pressing member, around the foot. Therefore, if the bag is inflated inside the binding member, the pressing member presses at least the arch of the sole and simultaneously the pressing member and the foot are moved toward the end portion of the support plate. In addition, since the base portion of the support plate is fixed to the lower leg and the end portion thereof is inclined relative to the base portion in a direction away from the foot, the foot is bent when the inflatable bag is inflated and the foot is moved toward the end portion. Moreover, when the inflation of the bag is stopped, the pressing member also stops pressing the sole, so that the foot is naturally returned to its stretched state. Since the foot can be iteratively bent and stretched by repeating these actions, the foot can be prevented from foot-drop. In addition, since at least the arch of the foot is pressed while the foot is bent, the foot is prevented from deep venous thrombosis.

According to a fourth feature of the present invention, there is provided an apparatus for bending and stretching a foot of a living person, comprising an inflatable bag which is opposed to an instep of the foot and a shin of a lower portion of an inferior limb of the person, the inflatable bag including a first portion which is opposed to the instep and is deformed, when the bag is inflated, to form a curved portion, the inflatable bag additionally including a second portion which is opposed to the lower portion and is worn on the lower portion such that the second portion is not movable relative to the lower portion; a pressurized-gas supplying device which supplies a pressurized gas to the inflatable bag; a pressing member which is provided in vicinity of a sole of the foot; and a connecting member which connects the inflatable bag and the pressing member to each other such that a distance between the inflatable bag and the pressing member is substantially unchangeable.

According to this feature, a portion of the inflatable bag is opposed, and fixed, to the lower leg, and the distance between the inflatable bag and the pressing member is kept unchanged by the connecting member. Therefore, when the inflatable bag is inflated and accordingly a portion of the bag that is opposed to the instep is deformed to form a curved portion, the pressing member is moved toward the sole to press the sole and thereby bend the foot. Meanwhile, when the inflation of the bag is stopped, the pressing member also stops pressing the sole, so that the foot is naturally returned to its stretched state. Since the foot can be iteratively bent and stretched by repeating these actions, the foot can be prevented from foot-drop. In addition, since at least the arch of the foot is pressed while the foot is bent, the foot is prevented from deep venous thrombosis.

According to a fifth feature of the present invention, there is provided an apparatus for bending and stretching a foot of a living person, comprising a bending device including an elongate flexible plate and a bellows tube held in close contact with the flexible tube, the bellows tube being opposed to an instep of the foot, one of lengthwise opposite end portions of the bending device being worn on a shin of a lower portion of an inferior limb of the person such that the one end portion of the bending device is not movable relative to the lower portion; a pressurized-gas supplying device which supplies a pressurized gas to the bellows tube of the bending device; a pressing member which is provided in vicinity of a sole of the foot; and a connecting member which connects the bending device and the pressing member to each other such that a distance between the bending device and the pressing member is substantially unchangeable.

According to this feature, when the bellows tube is supplied with the pressurized gas and is inflated, the flexible plate is so curved that the curved flexible plate is located inside the inflated bellows tube. Since one of lengthwise opposite end portions of the bending device is fixed to the shin of the lower leg, a portion of the bending device that is opposed to the instep is curved in a direction away from the instep, when the bending device is curved. In addition, since the distance between the bending device and the pressing member is kept unchanged by the connecting member. Therefore, when the bending device is curved in a direction away from the instep, the pressing member presses the sole and thereby bends the foot. Meanwhile, when the pressurized gas is discharged from the bellows tube, the pressing member also stops pressing the sole, so that the foot is naturally returned to its stretched state. Since the foot can be iteratively bent and stretched by repeating these actions, the foot can be prevented from foot-drop. In addition, since at least the arch of the foot is pressed while the foot is bent, the foot is prevented from deep venous thrombosis.

According to a sixth feature of the present invention, the foot bending and stretching apparatus further comprises an annular inflatable bag which is adapted to support a heel of the foot, the annular bag being inflated to lift the heel off a floor.

When the annular bag of this foot bending and stretching apparatus is inflated, the heel is lifted off the floor. When the heel is sometimes lifted off the floor, the foot can be prevented from bedsore.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF PREFERRED EMBODIMENTS

Figure 1:
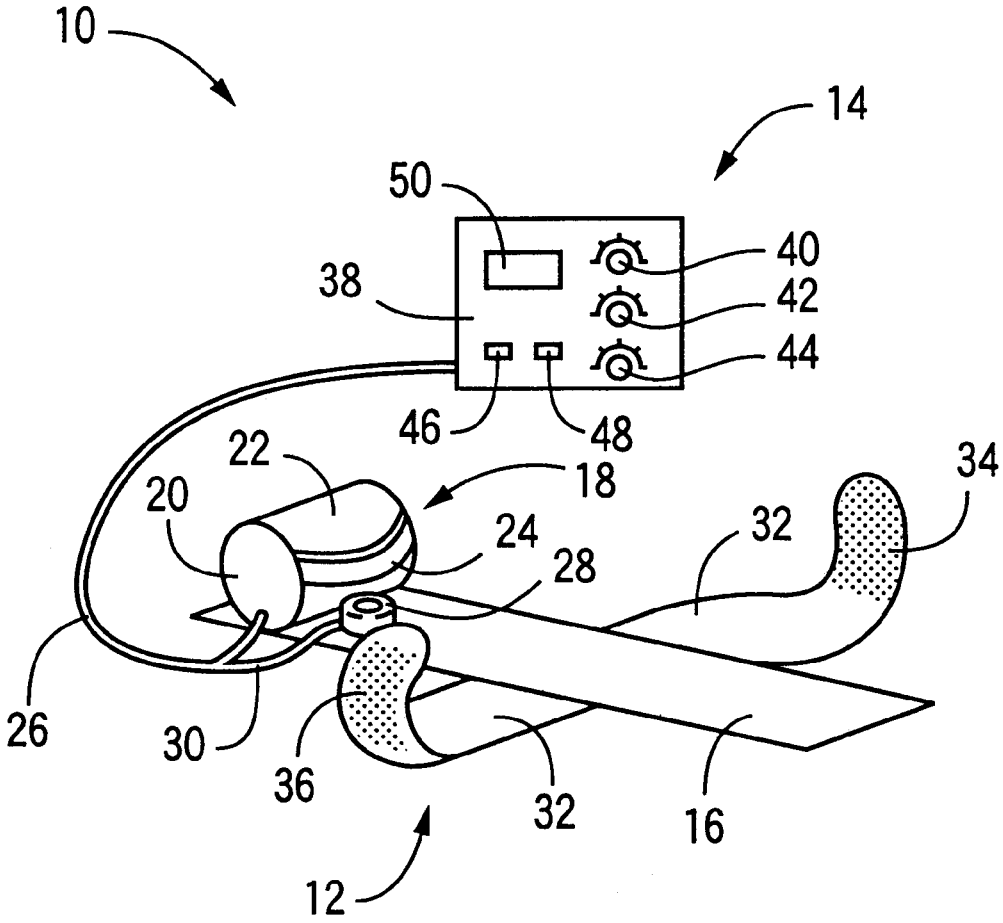
FIG. 1 is a view for explaining a construction of a foot bending and stretching apparatus to which the present invention is applied.

Hereinafter, there will be described a preferred embodiment of the present invention in detail by reference to the accompanying drawings. FIG. 1 shows a view for explaining a construction of a foot bending and stretching apparatus 10 to which the present invention is applied. The apparatus 10 includes a bending and stretching device 12 which is adapted to be worn on an inferior limb, not shown, of a living person, and an air charging and discharging device 14.

The bending and stretching device 12 includes an elongate support plate 16 which has a considerably high rigidity and supports the inferior limb, not shown. The support plate 16 has a length of from 30 to 80 cm, and a width (e.g., from 20 to 30 cm) slightly greater than a width of a lower leg (i.e., a portion of a leg between its knee and its foot joint). An air bag 18 functioning as a gas bag is fixed to one of lengthwise opposite end portions of the support plate 16. In a state in which the air bag 18 is fully inflated, the air bag 18 takes a generally cylindrical shape. The air bag 18 has an axial length substantially equal to the width of the support plate 16, so that opposite end walls 20 of the air bag 18 are substantially aligned with opposite long sides of the support plate 16, respectively. The diameter of the cylindrical shape taken by the air bag 18 is equal to from one third, to a full size, of a foot of a common adult person.

The air bag 18 has a foot fastening 24 which is engageable with an instep of a foot, not shown, of the person, so as to fasten the foot against a cylindrical surface 22 of the bag 18. The pedal belt 24 is provided at a position on the cylindrical surface 22 that is distant from a top position of the surface 22 by a distance equal to from one sixth to one fourth of a circumferential length of the surface 22 in a direction toward the other end portion of the support surface 16 that is opposite to the one end portion thereof to which the air bag 18 is fixed. An air hose 26 is connected to one of the two end walls 20 of the air bag 18, so as to be communicated with an inner space of the air bag 18.

An annular bag 28 is fixed to an upper surface of the support plate 16, such that an axis of the annular bag 28 is perpendicular to the support plate 16. The annular bag 28 is provided at a widthwise, substantially middle position on the support plate 16, and at a position distant from the position where the air bag 18 is fixed, by a distance equal to from the radius, to the diameter of, the air bag 18, in the direction toward the above-indicated other end portion of the support surface 16. The annular bag 28 supports a heel of the foot, not shown, such that the heel fits in an inner space of the annular bag 28. The position where the annular bag 28 is provided is so determined that when the heel fits in the annular bag 26, the arch of the foot can contact the cylindrical surface 22 of the air bag 18. The annular bag 28 has a diameter (e.g., 5 cm) which is equal to, or greater by several centimeters than, the diameter of a circle of substantially the same size as that of an area of the heel that supports the weight of the heel in a state in which the person is taking a face-up position. The annular bag 28 has an axial length, e.g., 5 cm, which assures that when the annular bag 28 is fully inflated, the heel supported thereby does not contact the support plate 16. The air hose 26 is connected to the annular bag 28 via a branch pipe 30.

The support plate 16 has, at a lengthwise, substantially middle position thereof, a pair of lower-leg fastening belts 32 whose respective one ends are fixed to the plate 16, such that each of the fastening belts 32 extends in a direction substantially perpendicular to the lengthwise direction of the plate 16. The fastening belts 32 are wound around a portion of the lower leg, not shown, to fasten the lower leg against the support plate 16. A mail fastener sheet 34 is adhered to an inner surface of a free end portion of one of the two belts 32, and a female fastener sheet 36 is adhered to an outer surface of a free end portion of the other belt 32.

The air charging and discharging device 14 includes an operation panel 38 which has a highest-pressure setting knob 40 which is operable for setting a highest air pressure $P_{MAX}$ (Pa) in the air bag 18; a pressure-increase-pattern setting knob 42 which is operable for setting a pressure-increase pattern according to which the air pressure is increased up to the highest air pressure $P_{MAX}$; a time-interval setting knob 44 which is operable for setting a time interval from the end of one pressure increasing operation to the start of another pressure increasing operation; a start button 46 which is operable for starting a pressure increasing operation to increase the air pressure of the air bag 18; a stop button 48 which is operable for stopping a pressure increasing operation; and a display device 50 which displays the air pressure in the air bag 18, etc.

Figure 2:
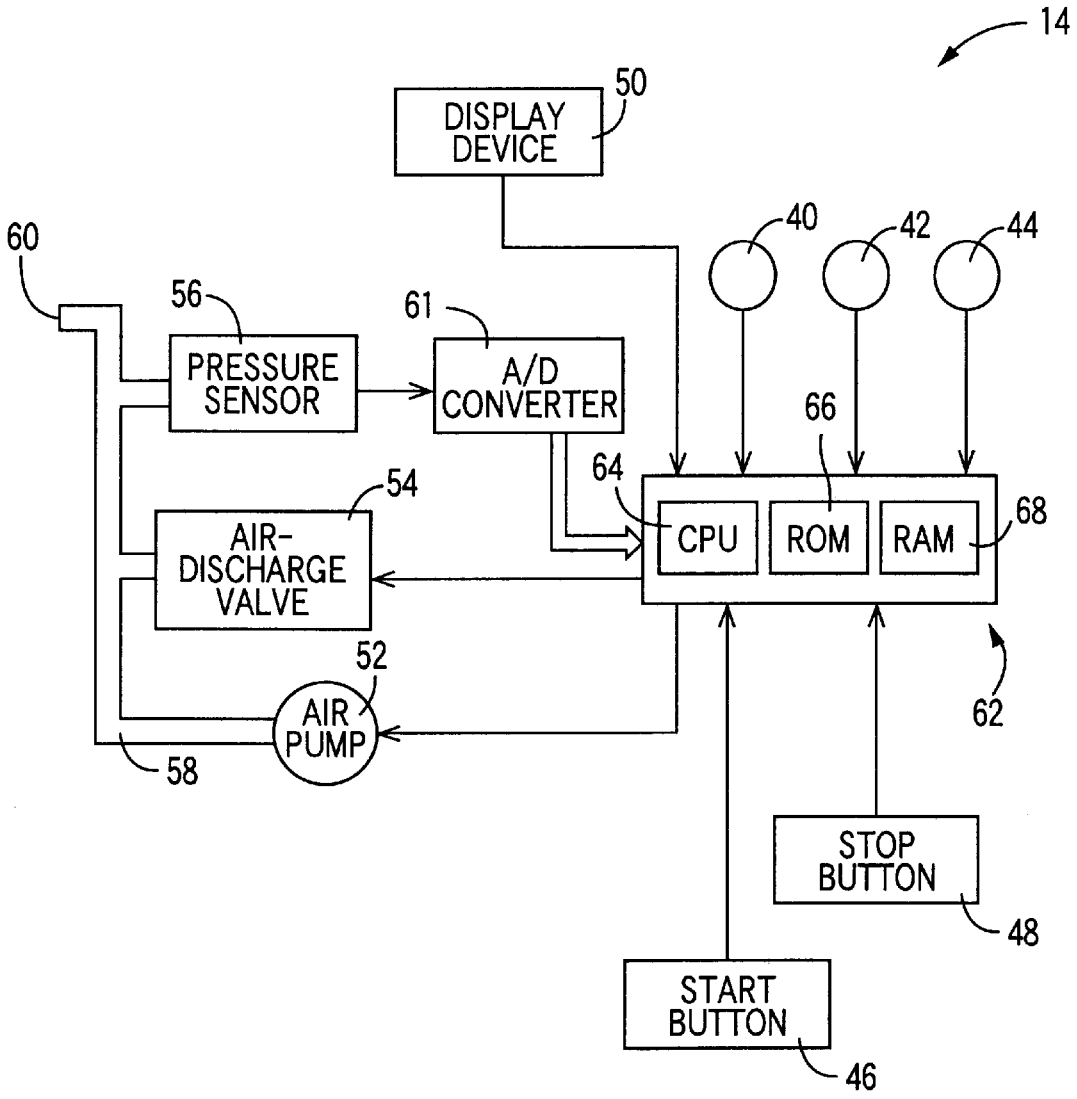
FIG. 2 is a block diagram for explaining a construction of an air charging and discharging device shown in FIG. 1.
Figure 3A:
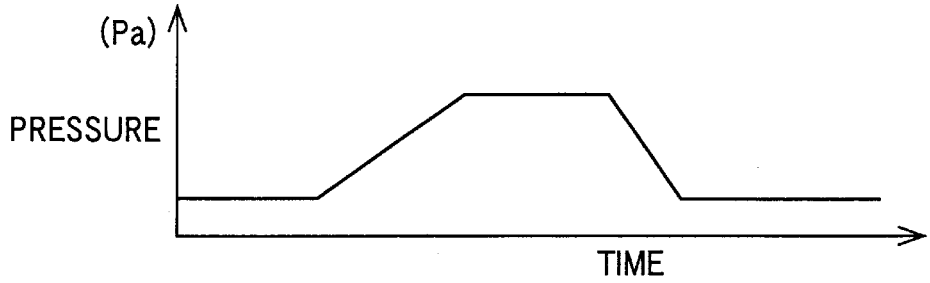
FIG. 3A is a view of a first pressure-increase pattern pre-stored in a ROM shown in FIG. 2.
Figure 3B:
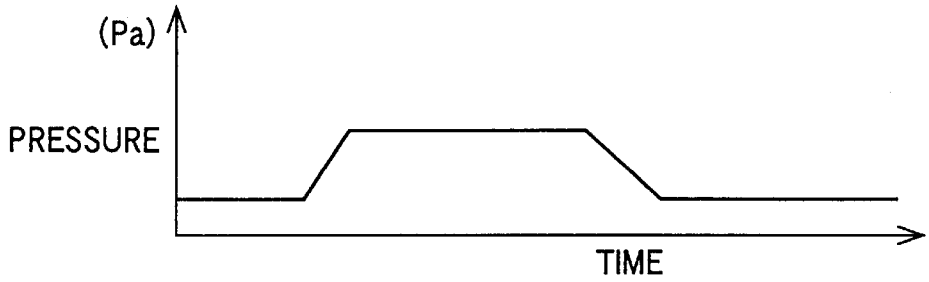
FIG. 3B is a view of a second pressure-increase pattern pre-stored in the ROM.
Figure 3C:
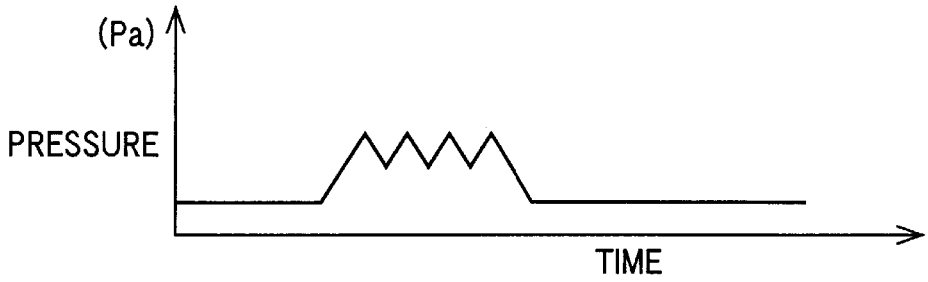
FIG. 3C is a view of a third pressure-increase pattern pre-stored in the ROM.
Figure 3D:
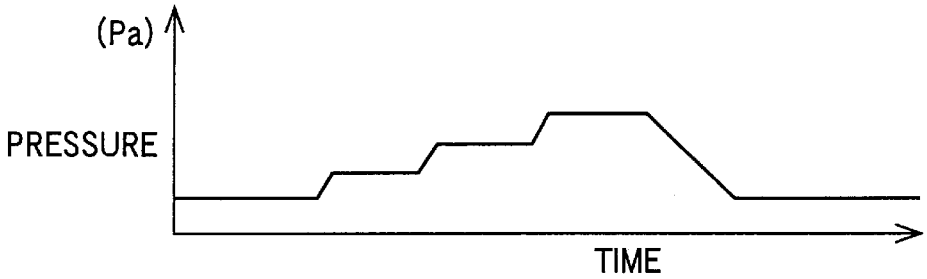
FIG. 3D is a view of a fourth pressure-increase pattern pre-stored in the ROM.

FIG. 2 is a diagrammatic view for explaining a construction of the air charging and discharging device 14. In FIG. 2, an air pump 52, an air-discharge valve 54, and a pressure sensor 56 are connected to one another via a piping 58. A connection end of the piping 58 is connected to the air hose 26. The air pump 52 functions as a pressurized-gas supplying device which supplies a pressurized air to the air bag 18 and the annular bag 28 via the piping 58 and the air hose 26. The air-discharge valve 54 discharges the pressurized air from the air bag 18. The pressure sensor 56 detects an air pressure in the piping 58, i.e., an air pressure in the air bag 18, and supplies a detection signal representing the detected air pressure, to a control device 62 via an A/D (analog-to-digital) converter 61.

The control device 62 is provided by a so-called microcomputer including a CPU (central processing unit) 64, a ROM (read only memory) 66, a RAM (random access memory) 68, and an I/O (input-and-output) port, not shown. The CPU 64 processes signals according to the control programs pre-stored in the ROM 66 by utilizing the temporary-storage function of the RAM 68, and controls the air pump 52 and the air-discharge valve 54 to increase the pressure in the air bag 18, up to the highest pressure PMAX set by the highest-pressure setting knob 40, according to the pressure-increase pattern selected by the pressure-increase-pattern setting knob 40 from a plurality of pressure-increase patterns pre-stored in the ROM 66. FIGS. 3A, 3B, 3C, and 3D show the stored pressure-increase patterns, respectively.

Figure 4A:
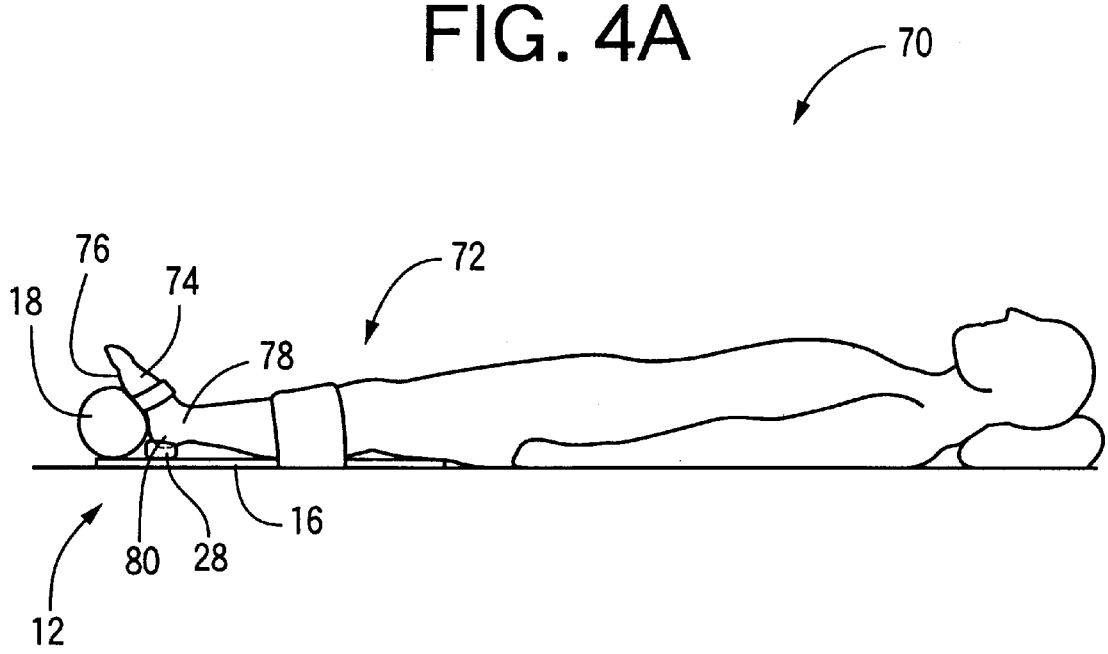
FIG. 4A is a view showing a state in which a bending and stretching device shown in FIG. 1 is worn on an inferior limb of a patient who is taking a face-up position and an air bag of the apparatus is fully inflated.
Figure 4B:
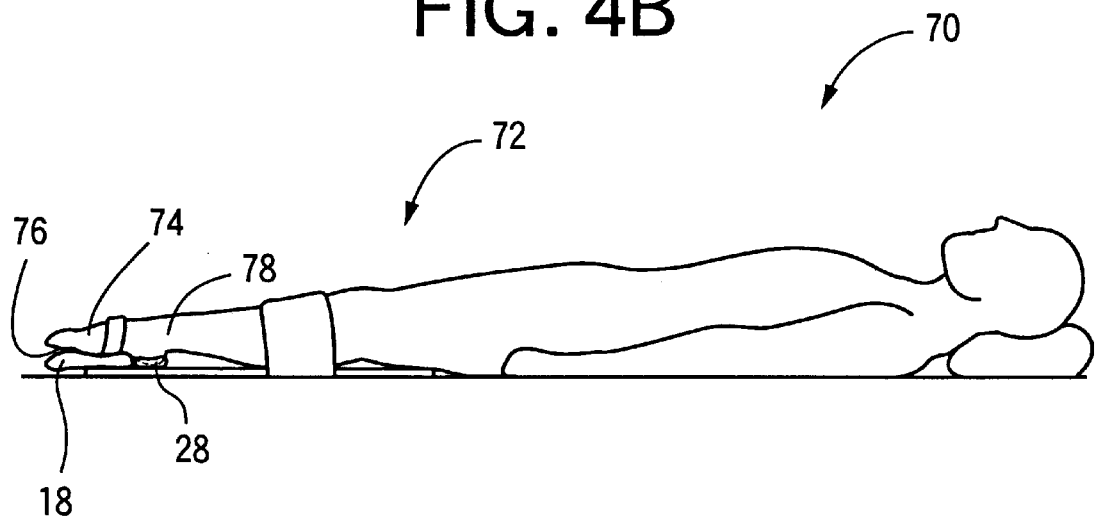
FIG. 4B is a view showing a state in which the bending and stretching device is worn on the inferior limb and the air bag of the device is fully deflated.

FIGS. 4A and 4B show respective states in which the bending and stretching device 12 is worn on an inferior limb 72 of a patient 70. More specifically described, FIG. 4A shows a state in which the air bag 18 is fully inflated; and FIG. 4B shows a state in which the air bag 18 is fully deflated. In FIGS. 4A and 4B, the air hose 26 and the branch pipe 30 are omitted. In the state, shown in FIG. 4B, in which the air bag 18 is fully deflated, a foot 74 is stretched and is placed on the air bag 18. As the pressurized air is supplied, in this state, to the air bag 18, the bag 18 is inflated to press an arch of a sole 76 of the foot 74 placed on the bag 18, in a circumferential direction of a circle whose center is on a foot joint 78, so that because of the pressing force, the foot 74 is bent eventually to the state shown in FIG. 4A. When the air bag 18 is supplied with the pressurized air, simultaneously the annular bag 28 is inflated to lift a heel 80 off the support plate 16.

As is apparent from the foregoing description of the foot bending and stretching apparatus 10, when the air bag 18 is inflated by the air pump 52, the air bag 18 presses the arch of the sole 76 of the foot 74 and thereby bends the foot 74. In addition, when the inflation of the air bag 18 is stopped, the pressing of the sole 76 is also stopped, so that the foot 74 is naturally returned to the stretched state. When the present apparatus 10 repeats this operation, the foot 74 is iteratively bent and stretched. Thus, the foot 74 can be prevented from foot-drop. Moreover, since the arch of the sole 76 is pressed while the foot 74 is bent, the foot 74 is also prevented from deep venous thrombosis.

In addition, in the foot bending and stretching apparatus 10, when the annular bag 28 is inflated, the heel 80 is lifted off the floor. If the heel 80 is frequently lifted off in this may, the foot 74 is prevented from bed sore.

Next, there will be described a second embodiment of the present invention. In the following description, the same reference numerals as used in the preceding, first embodiment shown in FIGS. 1, 2, 3A to 3D, 4A, and 4B are used to designate the corresponding elements of the present embodiment, and the description thereof is omitted.

Figure 5A:
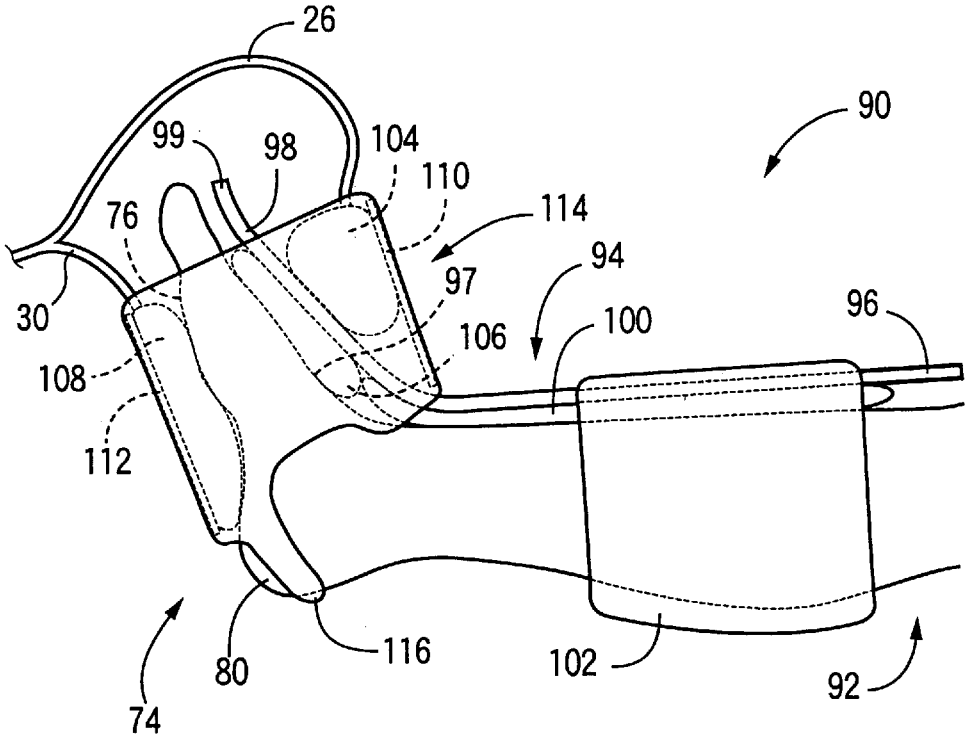
FIG. 5A is a view showing a state in which a bending and stretching device of another foot bending and stretching apparatus as a second embodiment of the present invention is worn on an inferior limb and a foot of the limb is bent by the bending and stretching device.
Figure 5B:
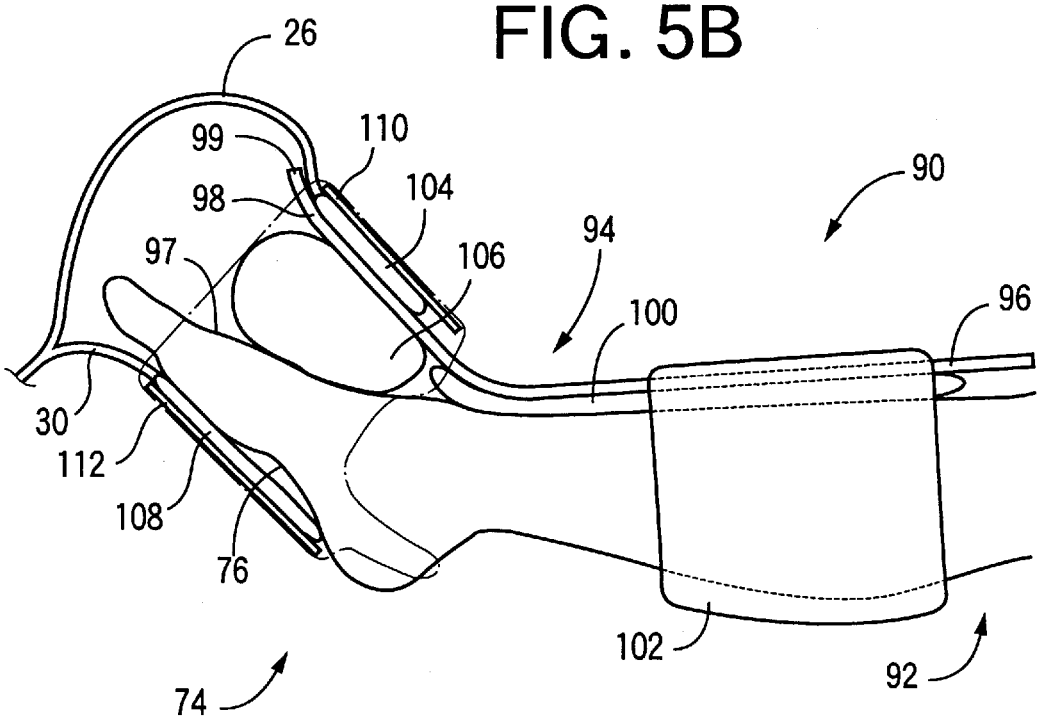
FIG. 5B is a view showing a state in which the bending and stretching device is worn on the inferior limb and the foot is stretched by the bending and stretching device.

FIGS. 5A and 5B show a state in which a bending and stretching device 90 which may be employed in place of the bending and stretching device 12 in the first embodiment shown in FIG. 1 is worn on a lower leg 92 of a living person. More specifically described, FIG. 5A shows a state in which a foot 74 is bent by the bending and stretching device 90, and FIG. 5B shows a state in which the foot 74 is stretched by the device 90.

The bending and stretching device 90 includes a support plate 94 which is adapted to be worn on a shin of the lower leg 92. The support plate 94 is provided by an elongate plate having a considerably high rigidity, and includes a base portion 96 which is adapted to be worn on the shin; an end portion 98 which is inclined by from 20 to 90 degrees (e.g., 45 degrees) with respect to the base portion 96, in a direction away from the foot 74, and which is opposed to an instep 97 of the foot 74 when the foot 74 is bent; and a tip portion 99 which is located at an end of the end portion 98 and is inclined with respect to the end portion 98 in a direction away from the foot 74. The support plate 94 has a width substantially equal to that of the lower leg 92.

A buffer member 100 is fixed to a lower surface of the base portion 96 of the support plate 94, and is positioned between the support plate 94 and the shin of the lower leg 92. The buffer member 100 is larger than a portion of the support plate 94 that contacts the lower leg 92. In addition, a fastening belt 102 is fixed to an upper surface of the base portion 96 of the support plate 94 and, when the fixing belt 102 is wound around the lower leg 92, the support plate 94 is attached to the lower leg 92 with the buffer member 100 being interposed between the plate 94 and the leg 92.

An air bag 104 functioning as a gas bag is fixed to one of opposite surfaces of the end portion 98 of the support plate 94 that is opposite to the other surface that is opposed to the foot 74. The air bag 104 is connected to an air hose 26 and is supplied with a pressurized air from an air pump 52 of an air charging and discharging device 14 (shown in FIG. 1). The air bag 104 has such a shape (e.g., a spherical shape) which assures that the air bag 104 is inflated in a direction substantially perpendicular to the end portion 98 of the support plate 94.

A cushion member 106 is fixed to the other surface of the end portion 98 of the support member 94 that is opposed to the instep 97 of the foot 74. The cushion member 106 has a great expansion and contraction efficiency and is considerably soft. In addition, a pressing air bag 108 functioning as a pressing member is provided in the vicinity of an arch of a sole 76, so that the air bag 108 contacts the arch. The air bag 108 is connected to the air hose 28 via a branch pipe 30. Thus, the two air bags 104, 108 are concurrently inflated and deflated.

The air bag 104 is provided between the end portion 98 of the support plate 94 and a first rectangular plate 110, and the pressing air bag 108 is provided between the sole 76 and a second rectangular plate 112. Each of the two rectangular plates 110, 112 has a considerably high rigidity, and has a width substantially equal to that of the foot 74 and a length equal to from one third to two thirds of that of the foot 74. The air bag 108 is fixed to the second plate 112.

A binding belt 114 as a binding member binds the rectangular plate 110, the air bag 104, the end portion 98 of the support plate 94, the cushion member 106, the foot 74, the pressing air bag 108, and the rectangular plate 112, with one another, in such a manner that the air bag 104 is inflatable. That is, the rectangular plate 110, the air bag 104, the end portion 98 of the support plate 94, the cushion member 106, the pressing air bag 108, and the rectangular plate 112 are worn on the foot 74, with the help of the binding belt 114, such that the air bag 104 is inflatable. The binding belt 114 includes an engaging portion 116 which extends from a sole-side portion thereof and engages a heel 80 of the foot 74, so as to prevent the binding belt 114 from coming off the foot 74.

The present foot bending and stretching apparatus includes the bending and stretching device 90 constructed as describe above, and the air charging and discharging device 14 connected to the device 90. Since, in this apparatus, the end portion 98 of the support plate 94, the air bag 104, the pressing air bag 108, and the foot 74 are bound by the binding belt 114, the pressing air bag 108 presses the arch and other portion of the sole 76, and the pressing air bag 10 and the foot 74 move toward the end portion 98 of the support plate 94, when the air bag 104 is inflated inside the binding belt 114. In addition, since the base portion 96 of the support plate 94 is fixed to the lower leg 92 and the end portion 98 is inclined relative to the base portion 96 in a direction away from the foot 74, the foot 74 is bent when the air bag 104 is inflated and the foot 74 moves toward the end portion 98 of the support plate 94. Meanwhile, when the inflation of the air bag 104 is stopped, the pressing air bag 108 also stops pressing the sole 76, so that the foot 74 is returned to its stretched state. When these actions are repeated, the foot 74 is repetitively bent and stretched and accordingly is prevented from foot-drop. Moreover, since the arch and other portion of the sole 76 is pressed while the foot 74 is bent, the foot 74 is also prevented from deep venous thrombosis.

Figure 6A:
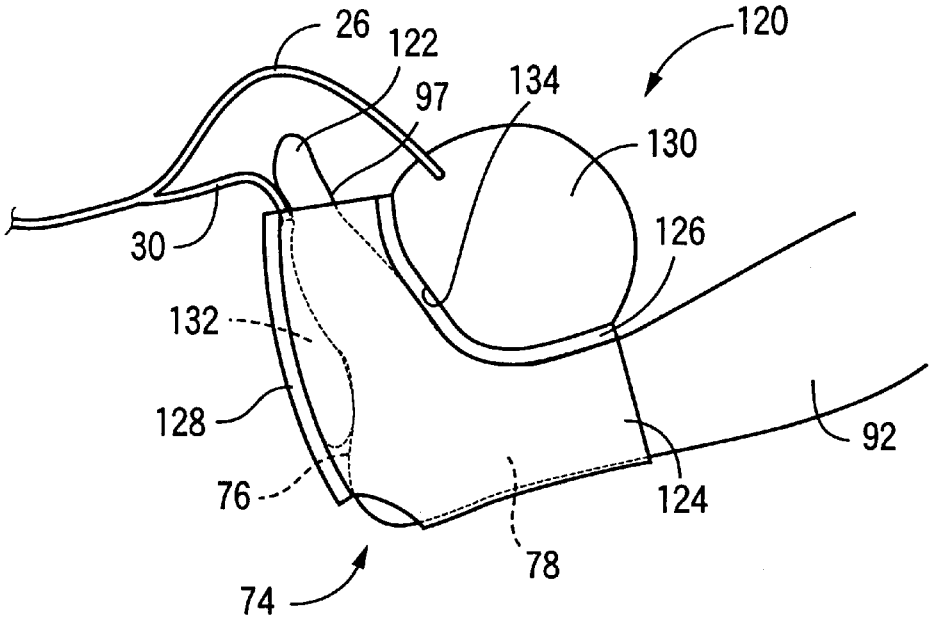
FIG. 6A is a view showing a state in which a bending and stretching device of another foot bending and stretching apparatus as a third embodiment of the present invention is worn on an inferior limb and a foot of the limb is bent by the bending and stretching device.
Figure 6B:
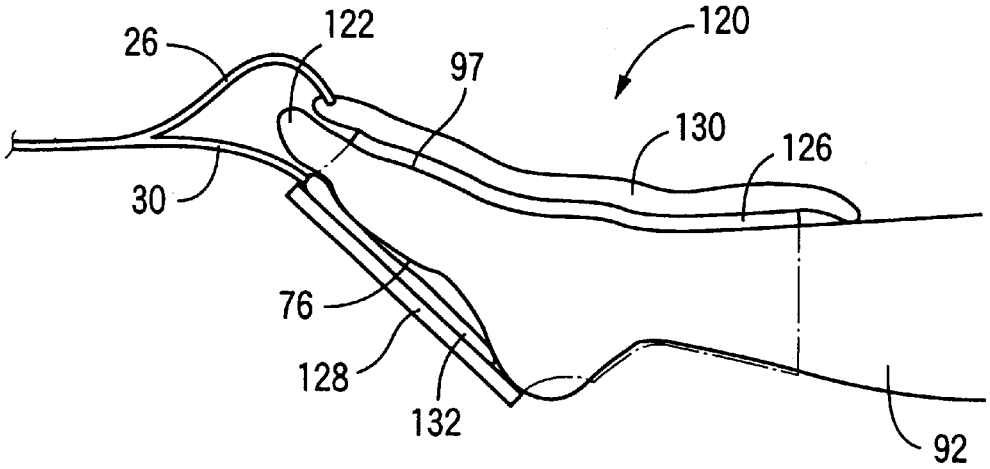
FIG. 6B is a view showing a state in which the bending and stretching device is worn on the inferior limb and the foot is stretched by the bending and stretching device.

Next, there will be described a third embodiment of the present invention. FIGS. 6A and 6B show a state in which a bending and stretching device 120 which may be employed in place of the bending and stretching device 12 in the first embodiment shown in FIG. 1 is worn on a lower leg 92 of a living person. More specifically described, FIG. 6A shows a state in which a foot 74 is bent by the bending and stretching device 120, and FIG. 6B shows a state in which the foot 74 is stretched by the device 120.

The bending and stretching device 90 includes a foot belt 124, a considerably soft, rectangular top plate 126, a flexible, rectangular bottom plate 128, a generally cylindrical air bag 130 functioning as a gas bag, and a pressing air bag 132 functioning as a pressing member. The foot belt 124 is wound around a foot 74, a foot joint 78, and a lower portion of a lower leg 92, in such a manner that toes 122 and a heel 80 of the foot 74 are exposed. The top plate 126 is adhered to an outer surface of an instep-side portion of the foot belt 124. The bottom plate 128 is adhered to an outer surface of a sole-side portion of the foot belt 124. The air bag 130 is adhered to an outer surface of the top plate 126, such that an axis of the cylindrical air bag 130 is perpendicular to a lengthwise direction of the top plate 126. The pressing air bag 132 is fixed to an inner surface of the sole-side portion of the foot belt 124, at a position where the air bag 132 contacts an arch of a sole 76. Thus, the air bag 130 is fixed via the top plate 126 to a portion of the foot belt 124 is opposed to the lower leg 92. The foot belt 124 is formed of a material having a considerably low degree of stretch, so that a distance between the top plate 126 or the air bag 130 adhered to the plate 126, and the bottom plate 128 is kept substantially unchanged. Thus, in the present embodiment, the foot belt 124 functions as a connecting member.

An air hose 26 is connected to the air bag 130, and an air pump 52 of the air charging and discharging device 14 supplies a pressurized air to the air bag 130 via the air hole 26, so as to inflate the air bag 130. In addition, a branch pipe 130 is connected to the pressing air bag 132, so that the pressing air bag 132 is inflated together with the air bag 130.

Since the air bag 130 has a cylindrical shape, when the pressurized air is supplied to the air bag 130 in its deflated state shown in FIG. 6B, so as to inflate the air bag 130, a surface of the air bag 130 that is adhered to the top plate 126 is deformed to form a curved surface 134, as shown in FIG. 6A.

The present foot bending and stretching apparatus includes the bending and stretching device 120 constructed as describe above, and the air charging and discharging device 14 connected to the device 120. Since, in this apparatus, the air bag 130 and the pressing air bag 132 are connected to each other by the foot belt 124, such that the distance between the two air bags 130, 132 is kept substantially unchanged, the pressing air bag 132 presses the sole 76, and thereby bends the foot 74, when the air bag 130 is inflated and accordingly the portion of the air bag 130 that is opposed to the instep 97 is deformed to form the curved surface 134. Meanwhile, when the inflation of the air bag 130 is stopped, the pressing air bag 132 also stops pressing the sole 76, so that the foot 74 is naturally returned to its stretched state. When these actions are repeated, the foot 74 is repetitively bent and stretched and accordingly is prevented from foot-drop. Moreover, since the arch and other portion of the sole 76 is pressed while the foot 74 is bent, the foot 74 is also prevented from deep venous thrombosis.

Figure 7A:
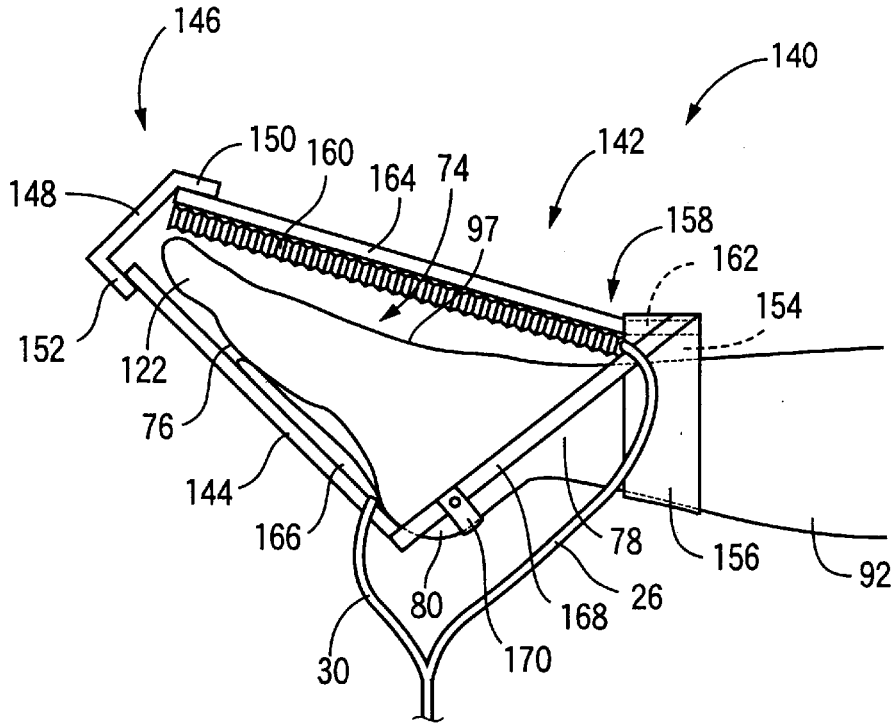
FIG. 7A is a view showing a state in which a bending and stretching device of another foot bending and stretching apparatus as a fourth embodiment of the present invention is worn on an inferior limb and a foot of the limb is stretched by the bending and stretching device.
Figure 7B:
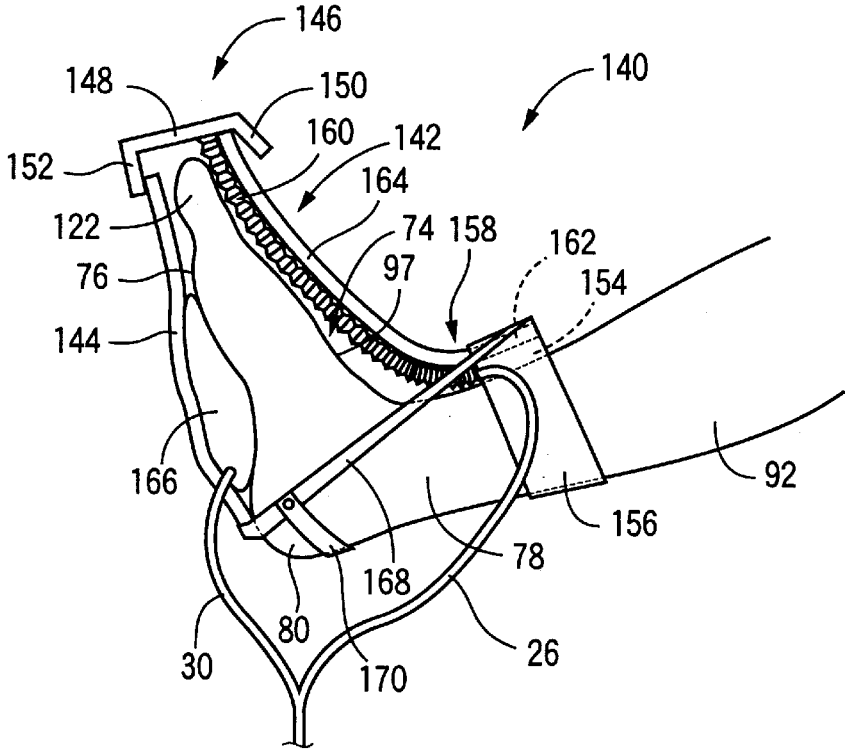
FIG. 7B is a view showing a state in which the bending and stretching device is worn on the inferior limb and the foot is bent by the bending and stretching device.

Next, there will be described a fourth embodiment of the present invention. FIGS. 7A and 7B show a state in which a bending and stretching device 140 which may be employed in place of the bending and stretching device 12 in the first embodiment shown in FIG. 1 is worn on a lower leg 92 of a living person. More specifically described, FIG. 7A shows a state in which a foot 74 is stretched by the bending and stretching device 140, and FIG. 7B shows a state in which the foot 74 is bent by the device 140.

The bending and stretching device 140 includes a bending device 142; a flexible rectangular bottom plate 144; and a connecting member 146. The bending device 142 is opposed to an instep 97, a foot joint 78, and a lower portion of a shin of the lower leg 92. The bottom plate 144 is opposed to toes 122, a sole 76, and a heel 80. The connecting member 146 connects between respective toe-side end portions of the bending device 142 and the bottom plate 144. The connecting member 146 is formed of a material having a considerably high degree of rigidity and a considerably low degree of stretch, and includes a main portion 148 which is opposed to the toes 122, and two projecting portions 150, 152 which project toward the bending device 142 and the bottom plate 144 and are fixed to respective outer surfaces of those elements 142, 144.

A cushion member 154 is adhered to an inner surface of an end portion of the bending device 142 that is located on the side of the foot joint 78. A fastening belt 156 is fixed to the end portion of the bending device 142, and is wound around the lower leg 92 to fasten the end portion of the bending device 142 via the cushion member 154 to the lower leg 92.

The bending device 142 includes an elongate flexible plate 158, and a bellows tube 160 which is closely adhered to an inner surface of the flexible plate 158 that is opposed to the instep 97. A plurality of bellows tubes 160 may be employed and provided such that the bellows tubes 160 extend parallel to each other. The flexible plate 158 includes a base portion 162 to which the fastening belt 156 is fixed; and a main portion 164 which is inclined, with respect to the base portion 162, by an angle (e.g., from 5 to 20 degrees) substantially equal to an angle by which the foot 74 in its stretched state is inclined with respect to the lower leg 92, in a direction in which the foot 74 is bent from its stretched state. One end of the bellows tube 160 is contiguous with the cushion member 154, and an air hose 26 is connected to the one end of the bellows tube 160. The bellows tube 160 has, in its deflected state, a length substantially equal to that of the main portion 164 of the flexible plate 158, and has, in its inflated state, a length longer than that of the main portion 164.

When an air pump 52 of the air charging and discharging device 14 supplies a pressurized air to the bellows tube 160 of the bending device 142, the bellows tube 160 is expanded in its lengthwise direction, so that a free end portion of the tube 160 contacts the main portion 148 of the connecting member 146. When the pressurized air is further supplied to the bellows tube 160, the flexible plate 158 of the bending device 142 is deformed, i.e., is curved outward in a direction away from the instep 97, because of a difference between respective expansion amounts of the bellows tube 160 and the flexible plate 158, that is, the same principle as the principle of operation of a bimetal.

A pressing air bag 166 functioning as a pressing member is fixed to an inner surface of the bottom plate 144, at a position where the air bag 166 contacts an arch of the sole 76. A branch pipe 30 is connected to the pressing air bag 166. Thus, the pressing air bag 166 is inflated together with the bellows tube 160. A bottom-plate fastening belt 168 is fixed, at one end thereof, to a heel-side end portion of the bottom plate 144, and is fixed, at the other end thereof, to a shin-side end portion of the fastening belt 156. Thus, the bottom-plate fastening belt 168 prevents the heel-side end portion of the bottom plate 144 from being separate from the heel 80. The bottom-plate fastening belt 168 includes an engaging belt 170 which is fixed to a heel-side portion of the fastening belt 168, and engages the heel 80 to prevent the bending and stretching device 140 from coming off the foot 74.

The present foot bending and stretching apparatus includes the bending and stretching device 140 constructed as describe above, and the air charging and discharging device 14 connected to the device 140. When the bellows tube 160 is supplied with the pressurized air from an air pump 52 of the air charging and discharging device 14, and accordingly is inflated, the flexible plate 158 of the bending device 142 is curved outward. Since the bending device 142 is fixed, at one of the lengthwise opposite ends thereof, to the shin-side portion of the lower leg 92, the flexible plate 158 is curved outward means that the portion of the flexible plate 158 that is opposed to the instep 97 is curved in a direction away from the instep 97. In addition, since the bending device 142 and the pressing air bag 166 are connected to each other by the connecting member 146 such that the distance between the two elements 142, 166 is kept substantially unchanged, that the flexible plate 158 is curved in the direction away from the instep 97 means that the pressing air bag 166 presses the sole 76, and thereby bends the foot 74 about the joint 78. Meanwhile, when the inflation of the bellows tube 160 is stopped, the pressing air bag 166 also stops pressing the sole 76, so that the foot 74 is returned to its stretched state. When these actions are repeated, the foot 74 is repetitively bent and stretched and accordingly is prevented from foot-drop. Moreover, since the arch and other portion of the sole 76 is pressed while the foot 74 is bent, the foot 74 is also prevented from deep venous thrombosis.

Figure 8:
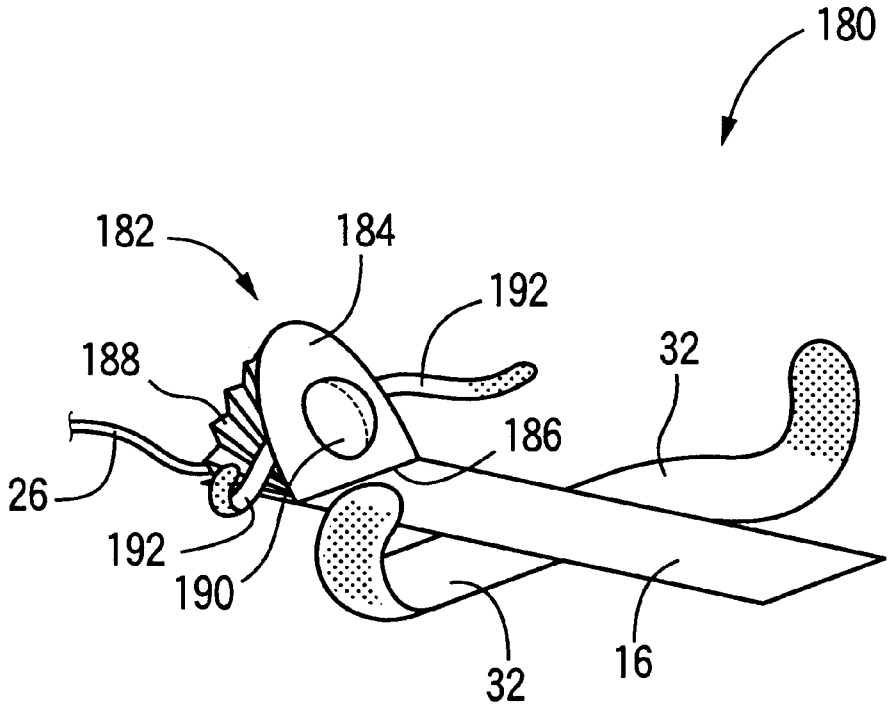
FIG. 8 is a view of a bending and stretching device of another foot bending and stretching apparatus as a fifth embodiment of the present invention.

Next, there will be described a fifth embodiment of the present invention. FIG. 8 shows a state in which a bending and stretching device 180 which may be employed in place of the bending and stretching device 12 in the first embodiment shown in FIG. 1 is worn on a leg of a living person. The bending and stretching device 180 employs an air bag 182 including a bellows 188, in place of the generally cylindrical air bag 18 of the bending and stretching device 12 shown in FIG. 1. Thus, in the present embodiment, the air bag 182 functions as a gas bag.

The air bag 182 has a top surface 184 on which a foot 74 is placed, and a bottom surface, not shown, which is fixed to a support plate 16. Each of the top surface 184 and the bottom surface has a generally semicircular shape. A chord 186 of the top surface 184 also defines a chord of the bottom surface. Thus, the top surface 184 is pivotable about the chord 186 as a pivot axis relative to the bottom surface. The bellows 188 provides a side surface connecting between the top surface 184 and the bottom surface, and thereby defines a locus of pivotal movement of the top surface 184 relative to the bottom surface. The top surface 184, the bottom surface, and the bellows 188 cooperate with one another to provide the air bag 182.

A projection member 190 which is formed of a considerably hard material is fixed to the top surface 184, at a position where the projection member 190 contacts an arch of a sole 76. A pair of foot fastening belts 192 are provided on both sides of the projection member 190, such that respective one ends of the two belts 192 are fixed to a peripheral edge of the top surface 182.

An air hose 26 is connected to the air bag 182 and, when an air pump 52 of an air charging and discharging device 14 supplies a pressurized air to the air bag 182 via the air hose 26, the air bag 182 is inflated, so that the top surface 184 is pivoted about the chord 186 in a direction away from the bottom surface, not shown. Thus, the air bag 182 presses the arch and other portion of the sole 76 of the foot 74 placed on the top surface 184, indirectly via the projection member 190, so that the foot 74 is bent about the joint 78.

The present foot bending and stretching apparatus includes the bending and stretching device 180 constructed as describe above, and the air charging and discharging device 14 connected to the device 180. When the air bag 182 is supplied with the pressurized air from the air pump 52, and accordingly is inflated, the air bag 182 indirectly presses the arc and other portion of the sole 76, thereby bends the foot 74. Meanwhile, when the inflation of the air bag 182 is stopped, the pressing of the sole 76 is also stopped, so that the foot 74 is returned to its stretched state. When these actions are repeated, the foot 74 is repetitively bent and stretched and accordingly is prevented from foot-drop. Moreover, since the arch and other portion of the sole 76 is pressed while the foot 74 is bent, the foot 74 is also prevented from deep venous thrombosis.

While the present invention has been described in its preferred embodiments by reference to the drawings, it is to be understood that the invention may otherwise be embodied.

For example, in each of the second to fourth embodiments, the pressing air bag 108, 132, 166 which is inflated by the pressurized air is employed as the pressing member and, in the fifth embodiment, the projection member 190 which has a considerably high rigidity and has a shape corresponding to the arch of the foot 74 is employed as the pressing member. However, in each of the second to fourth embodiments, the air bag 108, 132, 166 may be replaced with the projection member 190.

In the third embodiment shown in FIGS. 6A and 6B, the cylindrical air bag 130 is employed. However, since it is required that only the portion of the air bag 130 that is opposed to the instep 97 be deformed, when the bag 130 is inflated, so as to form the curved surface 134, the cylindrical air bag 130 may be replaced with a semi-cylindrical air bag having a shape obtained by cutting a cylinder along a plane passing through its axis.

In each of the illustrated embodiments, the air pump 52 is employed as a pressurized-gas supplying device. However, a pressurized-air supplying piping which is provided in each ward may be used as the pressurized-gas supplying device. In addition, the pressurized gas may be different from the pressurized air, for example, pressurized carbonic acid gas or nitrogen gas. In the latter case, a gas cylinder in which pressurized carbonic acid gas or nitrogen gas is charged, or a piping which supplies pressurized carbonic acid gas or nitrogen gas is used as the pressurized-gas supplying device.

It is to be understood that the present invention may be embodied with other changes, improvements and modifications that may occur to a person skilled in the art without departing from the spirit and scope of the invention defined in the appended claims.

What is claimed is:

1. An apparatus for bending and stretching a foot of a living person, comprising:

a pressurized-gas supplying device which supplies a pressurized gas;

an inflatable bag which is provided in vicinity of an arch of a sole of the foot, and is inflated by the pressurized gas supplied by the pressurized-gas supplying device, so as to press at least the arch of the sole of the foot; and an annular inflatable bag which is adapted to support a heel of the foot, the annular bag being inflated to lift the heel off a floor.

2. An apparatus for bending and stretching a foot of a living person, comprising:

a bending device which bends the foot relative to a lower portion of an inferior limb of the person; and a pressing device which presses at least an arch of a sole of the foot, wherein the bending device comprises an inflatable member; and a pressurized-gas supplying device which supplies a pressurized gas to the inflatable member so as to inflate the inflatable member, wherein the pressurized-gas supplying device comprises a target-pressure selecting device which is operable by an operator to select a target pressure of the pressurized gas supplied by the supplying device to the inflatable member, wherein the pressurized-gas supplying device further comprises a memory device which stores a plurality of pressure-change patterns according to each of which the pressurized-gas supplying device increases the pressure of the pressurized gas supplied thereby to the inflatable member, up to the target pressure selected by the target-pressure selecting device; and a pressure-change-pattern selecting device which is operable by the operator to select one of said plurality of pressure-change patterns stored in the memory device, so that according to the selected pressure-change pattern, the pressurized-gas supplying device increases the pressure of the pressurized gas supplied thereby to the inflatable member, up to the selected target pressure.

3. An apparatus according to claim 2, wherein the bending device comprises an inflatable bag, as the inflatable member, which is provided in vicinity of the arch of the sole of the foot, and is inflated by the pressurized gas supplied by the pressurized-gas supplying device, so as to press at least the arch of the sole of the foot, and wherein the pressing device comprises the inflatable bag.

4. An apparatus according to claim 2, wherein the pressing device comprises a pressing member which is provided in vicinity of the arch of the sole of the foot, and wherein the bending device comprises:

a support plate including a base portion which is adapted to be worn on the lower portion of the inferior limb of the person such that the base portion is not movable relative to the inferior limb, and an end portion which is inclined relative to the base portion in a direction away from the foot of the inferior limb and is opposed to an instep of the foot;

an inflatable bag, as the inflatable member, which is provided on one of opposite sides of the end portion of the support plate that is opposite to the instep; and a binding member which binds the end portion of the support plate, the inflatable bag, and the pressing member, around the foot, such that the bag is inflatable by the pressurized gas plied by the pressurized-gas supplying device.

5. An apparatus according to claim 2, wherein the pressing device comprises a pressing member which is provided in vicinity of the sole of the foot, and wherein the bending device comprises:

an inflatable bag, as the inflatable member, which is opposed to an instep of the foot and a shin of the lower portion of the inferior limb of the person, the inflatable bag including a first portion which is opposed to the instep and is deformed, when the bag is inflated, to form a curved portion, the inflatable bag additionally including a second portion which is opposed to the lower portion and is worn on the lower portion such that the second portion is not movable relative to the lower portion; and a connecting member which connects the inflatable bag and the pressing member to ea other such that a distance between the inflatable bag and the pressing member is substantially unchangeable.

6. An apparatus according to claim 2, wherein the pressing device comprises a pressing member which is provided in vicinity of the sole of the foot, and wherein the bending device comprises:

an elongate flexible plate and a bellows tube, as the inflatable member, fixed to the flexible plate, the bellows tube being opposed to an instep of the foot, one of lengthwise opposite end portions of the bending device being worn on a shin of the lower portion of the inferior limb of the person such that said one end portion of the bending device is not movable relative to the lower portion; and a connecting member which connects the bending device and the pressing member to each other such that a distance between the bending device and the pressing member is substantially unchangeable.

7. An apparatus according to claim 3, wherein the bending device further comprises:

an elongate support member which is adapted to support at least the lower portion of the inferior limb of the person that includes the foot; and a first fastening device which is adapted to fasten the lower portion to the support member such that the lower leg including the foot is not movable relative to the support member, wherein the inflatable bag is fixed to one of lengthwise opposite end portions of the elongate support member, so that the inflatable bag is positioned in vicinity of the arch of the sole of the foot fastened to the support member.

8. An apparatus according to claim 7, wherein the bending device further comprises a second fastening device which is adapted to engage an instep of the foot and thereby fasten the foot to the inflatable bag fixed to said one end portion of the elongate support member.

9. An apparatus according to claim 8, comprising an annular inflatable bag which is fixed to a portion of the elongate support member that is located near the inflatable bag and which is adapted to support a heel of the foot fastened to the inflatable bag by the second fastening device, the annular bag being inflated by the pressurized gas supplied by the pressurized-gas supplying device, so as to lift the heel off the support member.

10. An apparatus according to claim 3, the inflatable bag co top surface, a bottom surface, and a bellows which connects between the top surface and the bottom surface to each other.

11. An apparatus according to claim 2, wherein the pressurized-gas supplying device comprises a time-interval selecting device which is operable by an operator to select a time interval at which the pressurized gas is supplied by the supplying device to the inflatable member to inflate the inflatable member and thereby press at least the arch of the sole of the foot.

* * * * *